US010823023B2

(12) United States Patent
Phelps

(10) Patent No.: US 10,823,023 B2
(45) Date of Patent: Nov. 3, 2020

(54) SELECTIVE ACOUSTIC SOUNDPROOFING DEVICE

(71) Applicant: Randy Phelps, McLeansboro, IL (US)

(72) Inventor: Randy Phelps, McLeansboro, IL (US)

( * ) Notice: Subject to any disclaimer, the term of this patent is extended or adjusted under 35 U.S.C. 154(b) by 384 days.

(21) Appl. No.: 15/855,446

(22) Filed: Dec. 27, 2017

(65) Prior Publication Data

US 2019/0195100 A1 Jun. 27, 2019

(51) Int. Cl.
*F01N 1/16* (2006.01)
*F01N 1/08* (2006.01)

(52) U.S. Cl.
CPC ..... *F01N 1/168* (2013.01); *F01N 1/083* (2013.01); *F01N 1/166* (2013.01)

(58) Field of Classification Search
CPC ..... F01N 1/168; F01N 1/166; F01N 1/083
USPC ..... 181/237, 254
See application file for complete search history.

(56) References Cited

U.S. PATENT DOCUMENTS 6,178,745 B1 * 1/2001 Meusen ..... F01N 1/16 181/241
6,598,390 B2 * 7/2003 Chang ..... F01N 1/006 181/227
6,612,400 B2 * 9/2003 Bravo ..... F01N 1/166 181/254
D581,335 S 11/2008 Contreras
7,510,051 B2 * 3/2009 Schrandt ..... F01N 1/08 180/219
9,062,590 B2 * 6/2015 Schooler ..... F01N 13/00
2003/0121720 A1 * 7/2003 Chang ..... F01N 1/082 181/254
2004/0108162 A1 6/2004 Couvrette
2005/0178612 A1 * 8/2005 Nohl ..... F01N 1/163 181/254
2008/0314679 A1 * 12/2008 Rowe ..... F01N 1/16 181/241
2009/0229913 A1 9/2009 Tonietto et al.
2010/0307864 A1 12/2010 Bohata
2016/0312673 A1 * 10/2016 Belt ..... F01N 1/083

FOREIGN PATENT DOCUMENTS

WO WO-9740264 A1 * 10/1997 ..... F01N 1/166
WO WO-2017079156 A1 * 5/2017 ..... F01N 9/00

* cited by examiner

*Primary Examiner* — Forrest M Phillips

(57) ABSTRACT

A selective acoustic soundproofing device for a vehicle includes a housing that is configured to couple to an exhaust system of the vehicle so that an internal space defined by the housing is in fluidic communication with the exhaust system. A wall that is coupled to the housing extends from proximate to the first end to proximate to the second end of the housing to define a first passage and a second passage through the housing. A selector that is coupled to the housing is configured to selectively direct sound pressure from the engine through the first and second passages. A baffle positioned in the first passage is configured for acoustic quieting of loudness of the sound pressure when the selector is positioned to direct the sound pressure from the engine through the first passage relative to when the selector is positioned to direct the sound pressure through the second passage.

14 Claims, 4 Drawing Sheets

SELECTIVE ACOUSTIC SOUNDPROOFING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to soundproofing devices and more particularly pertains to a new soundproofing device for a vehicle.

BRIEF SUMMARY OF THE INVENTION

An embodiment of the disclosure meets the needs presented above by generally comprising a housing that is configured to couple to an exhaust system of a vehicle so that an internal space defined by the housing is in fluidic communication with the exhaust system. A wall that is coupled to the housing extends from proximate to the first end to proximate to the second end of the housing to define a first passage and a second passage through the housing. A selector that is coupled to the housing is configured to selectively direct sound pressure from an engine of the vehicle through the first passage and second passage. A baffle positioned in the first passage is configured for acoustic quieting of loudness of the sound pressure when the selector is positioned to direct the sound pressure from the engine through the first passage relative to when the selector is positioned to direct the sound pressure through the second passage.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
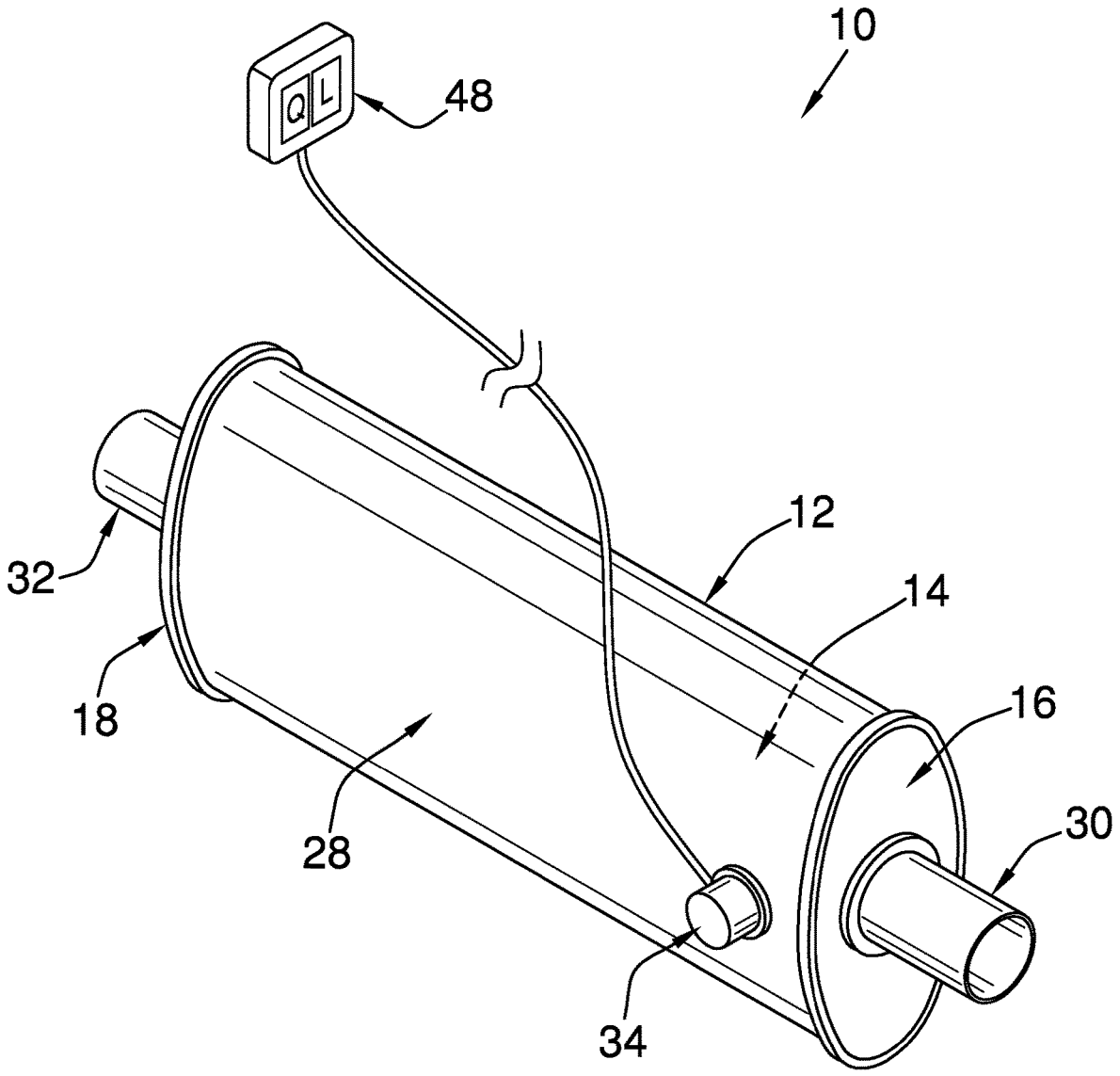
FIG. 1 is an isometric perspective view of a selective acoustic soundproofing device according to an embodiment of the disclosure.

With reference now to the drawings, and in particular to FIGS. 1 through 5 thereof, a new soundproofing device embodying the principles and concepts of an embodiment of the disclosure and generally designated by the reference numeral 10 will be described.

Figure 2:
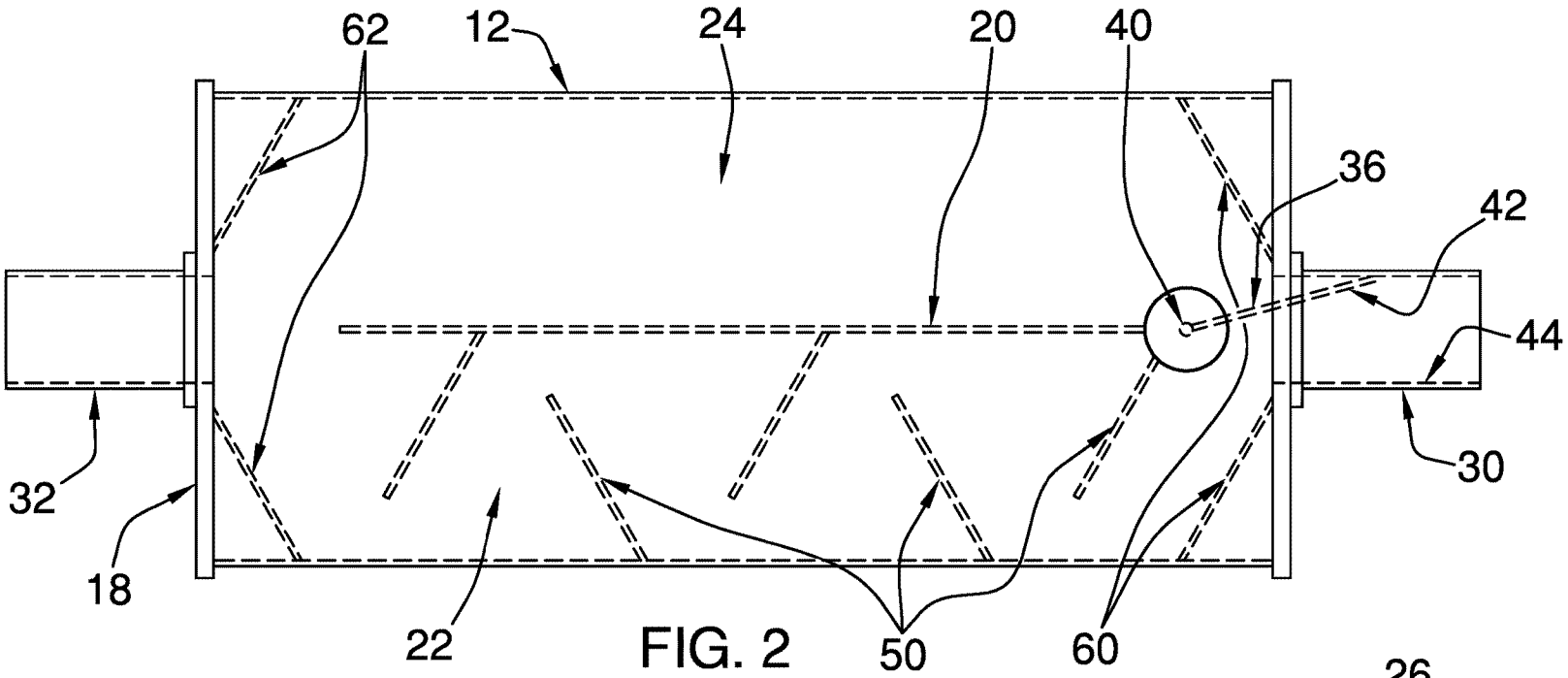
FIG. 2 is a bottom view of an embodiment of the disclosure.
Figure 3:
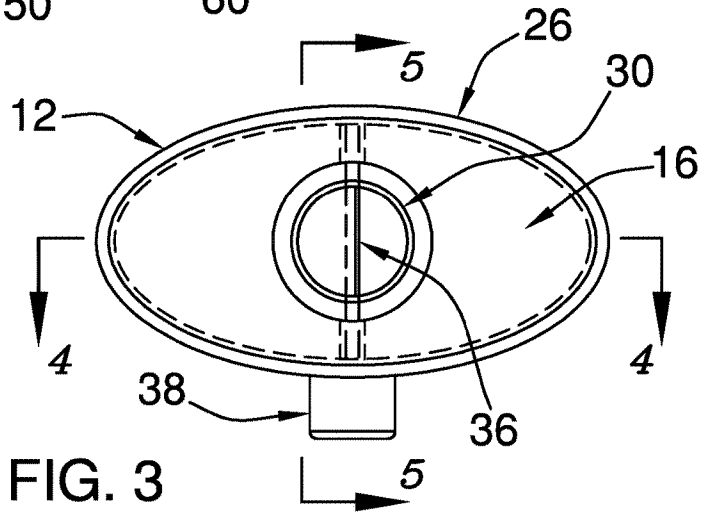
FIG. 3 is an end view of an embodiment of the disclosure.

As best illustrated in FIGS. 1 through 5, the selective acoustic soundproofing device 10 generally comprises a housing 12 that defines an internal space 14. The housing 12 has a first end 16 and a second end 18. The first end 16 and the second end 18 are configured to couple to an exhaust system of a vehicle so that the internal space 14 is in fluidic communication with the exhaust system. The housing 12 is ovally shaped when viewed longitudinally, as shown in FIG. 3.

Figure 4:
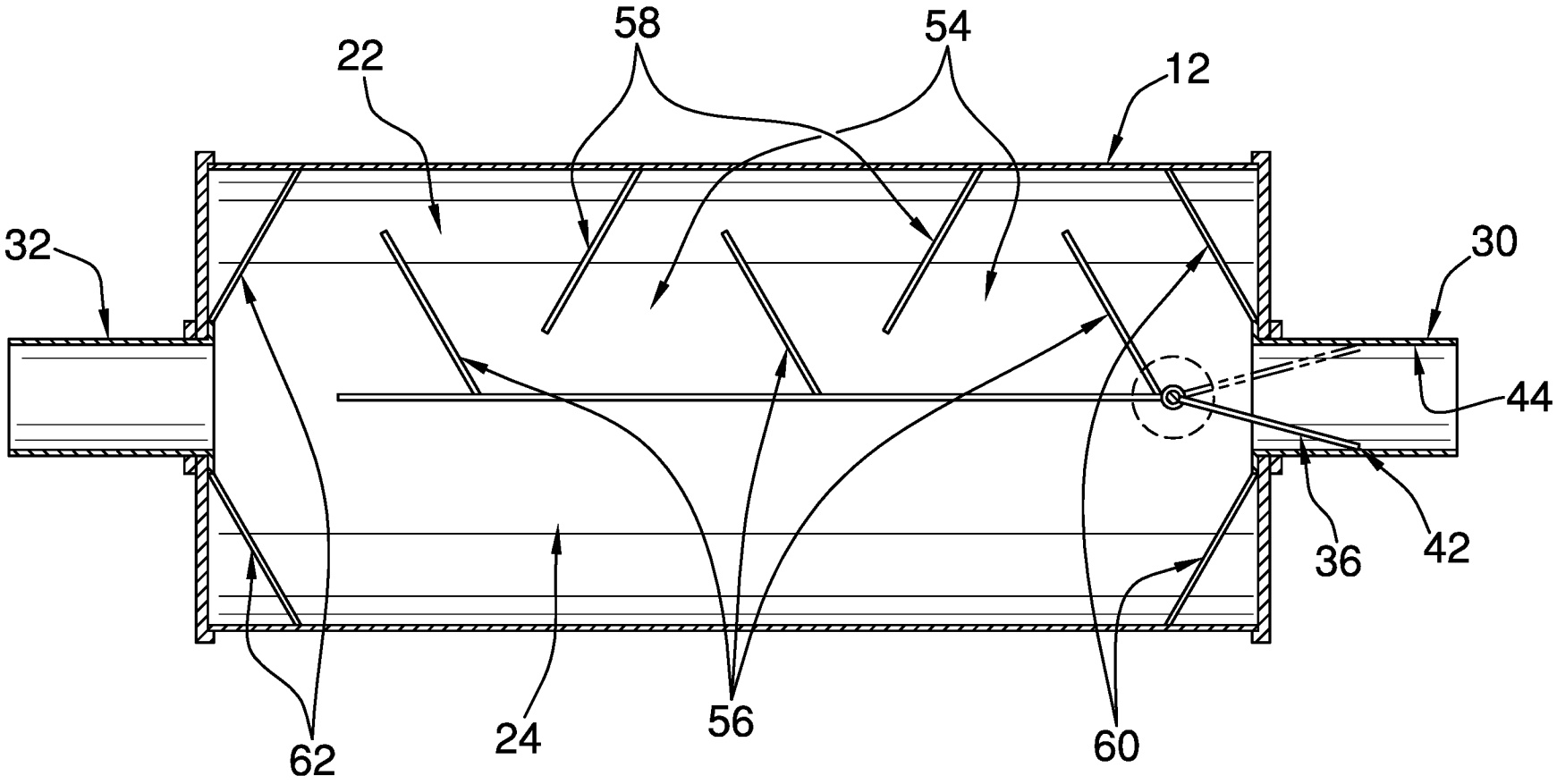
FIG. 4 is a cross-sectional view of an embodiment of the disclosure.
Figure 5:
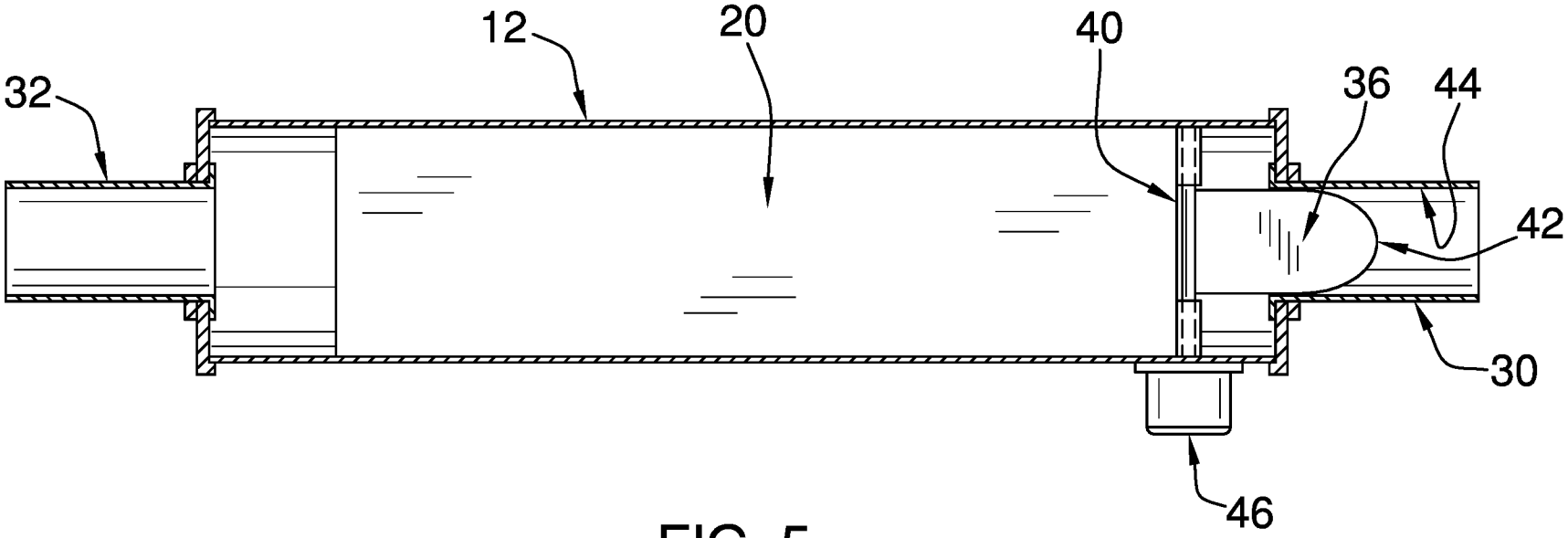
FIG. 5 is a cross-sectional view of an embodiment of the disclosure.

A wall 20 is coupled to the housing 12 and is positioned in the internal space 14. The wall 20 extends from proximate to the first end 16 to proximate to the second end 18 of the housing 12 to define a first passage 22 and a second passage 24 between the first end 16 and the second end 18 of the housing 12, as shown in FIG. 4. The wall 20 is coupled to and extends between a top 26 and a bottom 28 of the housing 12.

Each of a plurality of first pipes 30 is coupled to and extends through the first end 16 of the housing 12. The first pipes 30 are in fluidic communication with the internal space 14. The first pipes 30 are configured to couple in-line to the exhaust system of the vehicle. The plurality of first pipes 30 comprises one first pipe 30. The first pipes 30 are circularly shaped when viewed longitudinally.

Each of a plurality of second pipes 32 is coupled to and extends through the second end 18 of the housing 12. The second pipes 32 are in fluidic communication with the internal space 14. The second pipes 32 are configured to couple in-line to the exhaust system of a vehicle. The plurality of second pipes 32 comprises one second pipe 32. The second pipes 32 are circularly shaped when viewed longitudinally.

A selector 34 is coupled to the housing 12 proximate to the first end 16 of the housing 12. The selector 34 is configured to selectively direct sound pressure from an engine of the vehicle through the first passage 22 and the second passage 24. The sound pressure from the engine primarily follows the same path as the exhaust from the engine, that is through the exhaust system of the vehicle.

The selector 34 comprises a first plate 36 and an actuator 38. The first plate 36 is hingedly coupled to an endpoint 40 of the wall 20 so that a terminus 42 of the first plate 36 extends into the first pipe 30. The terminus 42 is arcuate so that the first plate 36 is positioned to pivot to position the terminus 42 adjacent to an inner surface 44 of the first pipe 30, as shown in FIG. 2. The actuator 38 is coupled to the housing 12 and is operationally coupled to the first plate 36. The actuator 38 is positioned to selectively pivot the first plate 36 to direct the sound pressure from the engine through the first passage 22 and the second passage 24. The actuator 38 comprises a servomotor 46 or the like.

A switch 48, shown in FIG. 1, is configured to couple to a surface of the vehicle proximate to a driver of the vehicle, such as on a dashboard of the vehicle. The switch 48 is operationally coupled to the actuator 38. The switch 48 is configured to allow the driver to selectively direct the actuator 38 to pivot the first plate 36 to direct the sound pressure from the engine through the first passage 22 and the second passage 24.

A baffle 50 is positioned in the first passage 22, as shown in FIG. 2. The baffle 50 is configured for acoustic quieting of loudness of the sound pressure generated by the engine when the selector 34 is positioned to direct the sound pressure through the first passage 22 relative to when the selector 34 is positioned to direct the sound pressure through the second passage 24. Directing the sound pressure from the engine through the first passage 22 will provide a higher level of noise reduction than when the sound pressure is directed through the second passage 24. Directing the sound pressure from the engine through the second passage 24 will provide higher engine efficiency and a reduction in fuel consumption than when the sound pressure is directed through the first passage 22.

The baffle 50 comprises a plurality of inserts 52 that is coupled to the housing 12 and is positioned in the first passage 22 to define a plurality of resonating chambers 54. The resonating chambers 54 are harmonically tuned to cause destructive interference of the sound pressure.

The plurality of inserts 52 comprises a plurality of second plates 56 and a plurality of third plates 58, as shown in FIG. 4. Each second plate 56 is coupled to and extends from the wall 20 into the first passage 22. Each second plate 56 extends transversely from the wall 20 toward the second end 18 of the housing 12. Each third plate 58 is coupled to and extends from the housing 12 into the first passage 22. Each third plate 58 extends transversely from the housing 12 toward the second end 18 of the housing 12. The second plates 56 and the third plates 58 are alternately positioned within the first passage 22. The plurality of second plates 56 comprises three second plates 56. The plurality of third plates 58 comprises two third plates 58.

Each of a pair of fourth plates 60 is coupled to and extends transversely from the housing 12 into the internal space 14 proximate to the first end 16. Each fourth plate 60 is coupled to the first end 16 adjacent to the first pipe 30. Each of a pair of fifth plates 62 is coupled to and extends transversely from the housing 12 into the internal space 14 proximate to the second end 18. Each fifth plate 62 is coupled to the second end 18 adjacent to the second pipe 32.

In use, the switch 48 is configured to allow the driver to selectively direct the actuator 38 to pivot the first plate 36 to direct the sound pressure from the engine through the first passage 22 and the second passage 24. The second plates 56 and the third plates 58 are positioned in the first passage 22 so that the resonating chambers 54 are harmonically tuned to cause destructive interference of the sound pressure for the acoustic quieting of the loudness of the sound pressure generated by the engine of the vehicle when the first plate 36 is positioned to direct the sound pressure from the engine through the first passage 22 relative to when the first plate 36 is positioned to direct the sound pressure from the engine through the second passage 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A selective acoustic soundproofing device comprising:

a housing defining an internal space, said housing having a first end and a second end, said first end and said second end being configured for coupling to an exhaust system of a vehicle such that said internal space is in fluidic communication with the exhaust system;

a wall coupled to said housing and positioned in said internal space, said wall extending from proximate to said first end to proximate to said second end of said housing defining a first passage and a second passage between said first end and said second end, said second passage being unrestricted between said first end and said second end;

a selector coupled to said housing proximate to said first end of said housing, said selector being configured for selectively directing sound pressure from the engine through said first passage and said second passage;

a baffle positioned in said first passage; and wherein said baffle is positioned in said first passage such that said baffle is configured for acoustic quieting of loudness of the sound pressure generated by the engine of the vehicle when said selector is positioned for directing the sound pressure from the engine through said first passage relative to when said selector is positioned for directing the sound pressure from the engine through said second passage.

2. The device of claim 1, further including said housing being ovally shaped when viewed longitudinally.

3. The device of claim 1, further including said wall being coupled to and extending between a top and a bottom of said housing.

4. The device of claim 1, further comprising:

a first pipe, said first pipe being coupled to and extending through said first end of said housing such that said first pipe is in fluidic communication with said internal space, said first pipe being configured for coupling in-line to the exhaust system of the vehicle; and a second pipe, said second pipe being coupled to and extending through said second end of said housing such that said second pipe is in fluidic communication with said internal space, said second pipe being configured for coupling in-line to the exhaust system of the vehicle.

5. The device of claim 4, further including said first pipe being circularly shaped when viewed longitudinally.

6. The device of claim 4, further including said second pipe being circularly shaped when viewed longitudinally.

7. The device of claim 5, further including said selector comprising:

a first plate hingedly coupled to an endpoint of said wall such that a terminus of said first plate extends into said first pipe, said terminus being arcuate such that said first plate is positioned for pivoting for positioning said terminus adjacent to an inner surface of said first pipe;

an actuator coupled to said housing, said actuator being operationally coupled to said first plate; and wherein said actuator is positioned on said housing such that said actuator is positioned for selectively pivoting said first plate for directing the sound pressure from the engine through said first passage and said second passage.

8. The device of claim 7, further including said actuator comprising a servomotor.

9. The device of claim 7, further including a switch configured for coupling to a surface of the vehicle proximate to a driver of the vehicle, said switch being operationally coupled to said actuator, wherein said switch is positioned proximate to the driver such that said switch is configured for the driver to selectively direct said actuator for pivoting said first plate for directing the sound pressure from the engine through said first passage and said second passage.

10. The device of claim 1, further including said baffle comprising a plurality of inserts coupled to said housing and positioned in said first passage defining a plurality of resonating chambers, wherein said inserts are positioned in said first passage such that said resonating chambers are harmonically tuned for causing destructive interference of the sound pressure.

11. The device of claim 10, further including said plurality of inserts comprising:

a plurality of second plates, each said second plate being coupled to and extending from said wall into said first passage, each said second plate extending transversely from said wall toward said second end of said housing, a plurality of third plates, each said third plate being coupled to and extending from said housing into said first passage, each said third plate extending transversely from said housing toward said second end of said housing such that said second plates and said third plates are alternately positioned within said first passage.

12. The device of claim 11, further including said plurality of second plates comprising three said second plates and said plurality of third plates comprising two said third plates.

13. The device of claim 1, further comprising:

a pair of fourth plates, each said fourth plate being coupled to and extending transversely from said housing into said internal space proximate to said first end, each said fourth plate being coupled to said first end adjacent to said first pipe; and a pair of fifth plates, each said fifth plate being coupled to and extending transversely from said housing into said internal space proximate to said second end, each said fifth plate being coupled to said second end adjacent to said second pipe.

14. A selective acoustic soundproofing device comprising:

a housing defining an internal space, said housing having a first end and a second end, said first end and said second end being configured for coupling to an exhaust system of a vehicle such that said internal space is in fluidic communication with the exhaust system, said housing being ovally shaped when viewed longitudinally;

a wall coupled to said housing and positioned in said internal space, said wall extending from proximate to said first end to proximate to said second end of said housing defining a first passage and a second passage between said first end and said second end, said wall being coupled to and extending between a top and a bottom of said housing, said second passage being unrestricted between said first end and said second end;

a first pipe, said first pipe being coupled to and extending through said first end of said housing such that said first pipe is in fluidic communication with said internal space, said first pipe being configured for coupling in-line to the exhaust system of the vehicle, said first pipe being circularly shaped when viewed longitudinally;

a second pipe, said second pipe being coupled to and extending through said second end of said housing such that said second pipe is in fluidic communication with said internal space, said second pipe being configured for coupling in-line to the exhaust system of the vehicle, said second pipe being circularly shaped when viewed longitudinally;

a selector coupled to said housing proximate to said first end of said housing, said selector being configured for selectively directing sound pressure from an engine of the vehicle through said first passage and said second passage, said selector comprising:

a first plate hingedly coupled to an endpoint of said wall such that a terminus of said first plate extends into said first pipe, said terminus being arcuate such that said first plate is positioned for pivoting for positioning said terminus adjacent to an inner surface of said first pipe, an actuator coupled to said housing, said actuator being operationally coupled to said first plate, wherein said actuator is positioned on said housing such that said actuator is positioned for selectively pivoting said first plate for directing the sound pressure from the engine through said first passage and said second passage, said actuator comprising a servomotor, and a switch configured for coupling to a surface of the vehicle proximate to a driver of the vehicle, said switch being operationally coupled to said actuator, wherein said switch is positioned proximate to the driver such that said switch is configured for the driver to selectively direct said actuator for pivoting said first plate for directing the sound pressure from the engine through said first passage and said second passage;

a baffle positioned in said first passage, wherein said baffle is positioned in said first passage such that said baffle is configured for acoustic quieting of loudness of the sound pressure generated by the engine of the vehicle when said selector is positioned for directing the sound pressure from the engine through said first passage relative to when said selector is positioned for directing the sound pressure from the engine through said second passage, said baffle comprising a plurality of inserts coupled to said housing and positioned in said first passage defining a plurality of resonating chambers, wherein said inserts are positioned in said first passage such that said resonating chambers are harmonically tuned for causing destructive interference of the sound pressure, said plurality of inserts comprising:

a plurality of second plates, each said second plate being coupled to and extending from said wall into said first passage, each said second plate extending transversely from said wall toward said second end of said housing, said plurality of second plates comprising three said second plates, and a plurality of third plates, each said third plate being coupled to and extending from said housing into said first passage, each said third plate extending transversely from said housing toward said second end of said housing such that said second plates and said third plates are alternately positioned within said first passage, said plurality of third plates comprising two said third plates;

a pair of fourth plates, each said fourth plate being coupled to and extending transversely from said housing into said internal space proximate to said first end, each said fourth plate being coupled to said first end adjacent to said first pipe;

a pair of fifth plates, each said fifth plate being coupled to and extending transversely from said housing into said internal space proximate to said second end, each said fifth plate being coupled to said second end adjacent to said second pipe; and wherein said switch is positioned proximate to the driver such that said switch is configured for the driver to selectively direct said actuator for pivoting said first plate for directing the sound pressure from the engine through said first passage and said second passage, wherein said second plates and said third plates are positioned in said first passage such that said resonating chambers are harmonically tuned for causing destructive interference of the sound pressure for the acoustic quieting of the loudness of the sound pressure generated by the engine of the vehicle when said first plate is positioned for directing the sound pressure from the engine through said first passage relative to when said first plate is positioned for directing the sound pressure from the engine through said second passage.

* * * * *